United States Patent [19]

Blanchot

[11] 4,456,091

[45] Jun. 26, 1984

[54] SILENCER IN STAINLESS MATERIAL FOR EXHAUST SYSTEMS OF AUTOMOBILE VEHICLES

[75] Inventor: Pierre Blanchot, Soisy sous Montmorency, France

[73] Assignee: Industeler, Paris, France

[21] Appl. No.: 342,662

[22] Filed: Jan. 25, 1982

[30] Foreign Application Priority Data

Jan. 23, 1981 [FR] France ..... 81 01209

[51] Int. Cl.[3] ..... F01N 7/18

[52] U.S. Cl. ..... 181/282; 181/243; 181/272

[58] Field of Search ..... 181/243, 244, 282, 272

[56] References Cited

U.S. PATENT DOCUMENTS 3,638,756 2/1972 Thiele ..... 181/282

*Primary Examiner*—Benjamin R. Fuller

*Attorney, Agent, or Firm*—Browdy & Neimark

[57] ABSTRACT

The silencer in stainless material for exhaust systems of automobile vehicles is made of two shells with crimped flanges. The bottom portion of the two shells have transverse corrugations on which rest the arcuate bottoms of holder elements of a box shape the vertical wings of which terminate by corrugated edges into which enter semi-circular corrugations of conformed plates. The two shells, the holder elements and the conformed plates are maintained in place by the crimped edges.

4 Claims, 6 Drawing Figures

SILENCER IN STAINLESS MATERIAL FOR EXHAUST SYSTEMS OF AUTOMOBILE VEHICLES

The present invention generally relates to a silencer to be incorporated into the exhaust system of an automobile vehicle, and more particularly to a silencer made of stainless steel or a similar material which suitably resists products exhausted from the engine of an automobile vehicle.

Silencers are known which are made from stainless steel or similar metal alloys, but there has always been great problems in manufacturing these silencers since stainless steel is a tough durable material which is difficult to work. Moreover if it is necessary to solder parts of the silencer together, the soldered junctions are points of weaker resistance which can rapidly be corroded, and therefore the advantages of stainless steel are very much reduced and even nullified. Yet, since stainless steel is a costly product, it is absolutely necessary to make the silencers by means providing a complete resistance to corrosion. The components of the silencers must be obtained by conventional process but also with a reduced tooling since said tooling is very costly, and it is necessary to reduce the tooling to a minimum in order to obtain an attractive manufacturing cost which (even if it produces an exhaust pipe at a price which is slightly higher than the price of a conventional exhaust pipe) must have for its result, due to the use of stainless steel, an economy in use since stainless steel will resist much better than conventional metal the hot gaseous and liquid products coming from an internal combustion engine.

Accordingly, the present invention creates a silencer which can be manufactured from a reduced number of standardized parts in order to manufacture many types of silencers according to the power and design of the engines in order to considerably reduce the manufacturing cost of the silencer.

According to the invention, the silencer in stainless material for exhaust systems of automobile vehicles, wherein the silencer is made of two shells with crimped flanges, is characterized in that the bottom portion of the two shells have transverse corrugations on which rest the arcuate bottoms of holder elements having a box shape, the vertical wings of which terminate at corrugated edges into which enter semi-circular corrugations of conformed plates, the two shells, the holder elements and the conformed plates being maintained in said conformed plates by the crimped edges.

According to another feature of the invention, the conformed plates are provided with holes on said semi-circular corrugations for communication of conducts formed by the conformed plates and the holder elements with the volumes formed by the two shells.

Other objects and further features of the present invention will be apparent from the following detailed description when read in conjunction with the accompanying drawings wherein.

Figure 1:
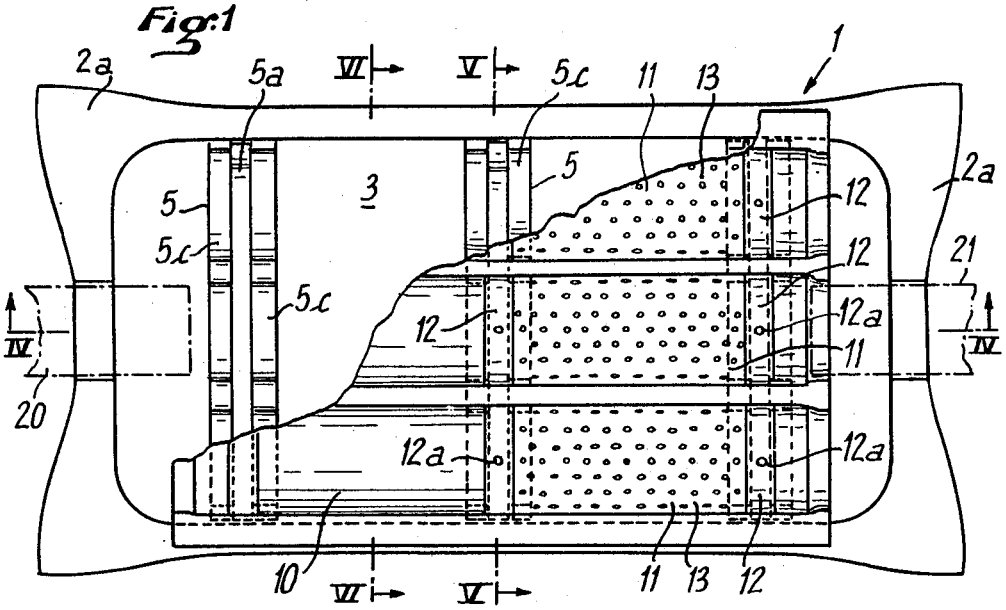
FIG. 1 is a partly exploded plan view of a silencer according to the invention.
Figure 2:
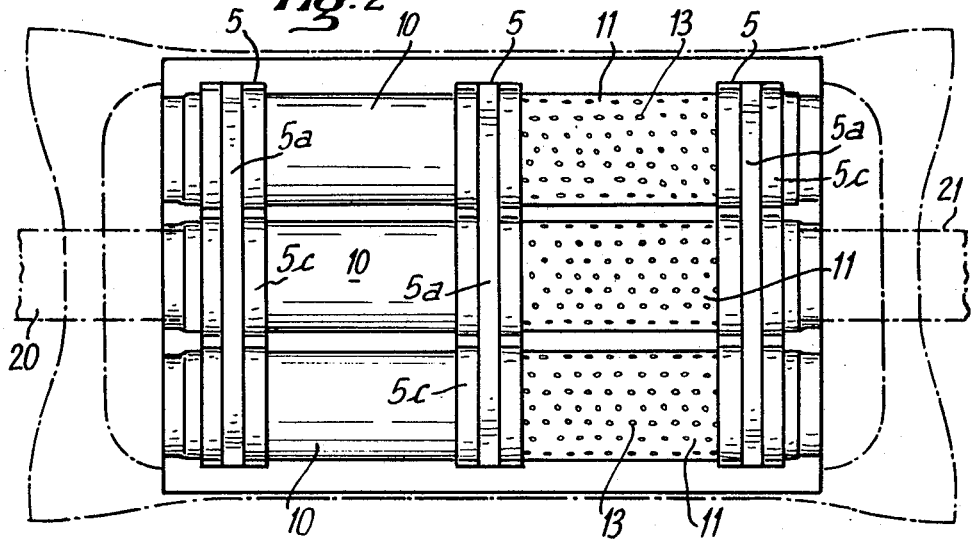
FIG. 2 shows an upper side of a silencer according to the invention with the upper shell being only diagrammatized.
Figure 3:
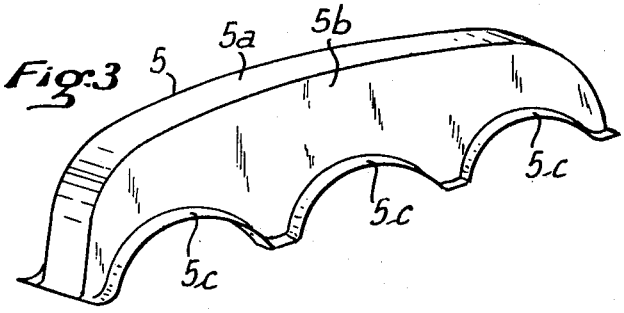
FIG. 3 is a perspective wiew of one of the elements of the silencer.
Figure 4:
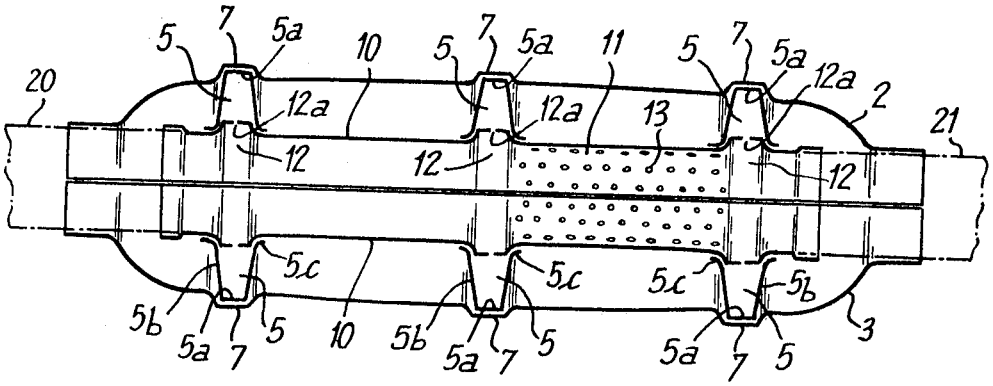
FIG. 4 is a cross-section of FIG. 1 taken along line IV—IV of FIG. 1.
Figure 5:
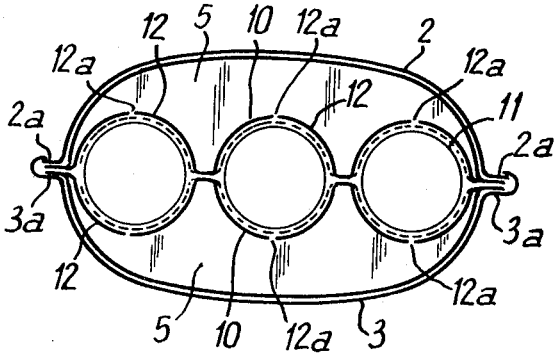
FIGS. 5 and 6 are cross-sections taken along lines V—V and VI—VI of FIG. 1.
Figure 6:
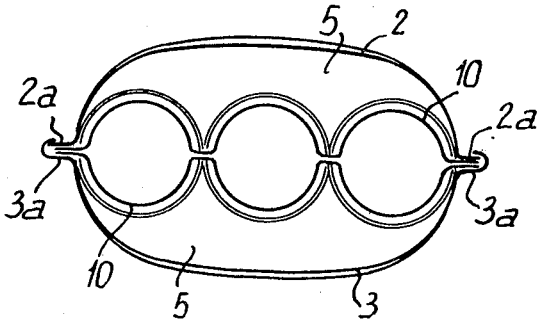

In the drawings, the silencer 1 is made of two shells 2,3 which are not obligatorily symmetrical the upper shell 2 being possibly of a greater volume than the lower shell 3. However, the shells 2 and 3 comprise, on their periphery, plane mating flanges 2*a*, 3*a*, which are superimposed in order to crimp the periphery of the silencer (FIGS. 5 and 6). Each of the shells 2,3 comprises three holder elements 5 of which one is shown in perspective in FIG. 3. As shown in the drawings, each of the holder elements 5 has the shape of a box with an arcuate bottom 5*a* and vertical wings 5*b* terminating at corrugated edges 5*c*. The arcuate bottom 5*a* is normally positioned in transverse stiffening corrugations or embossements 7 provided in the arcuate walls of the shells 2 and 3 (FIG. 4), and thus the corrugations 7 are immediately reinforced by the holder elements 5 which are obtained by a stamping operation, as are also obtained each of the shells 2,3. When the holder elements 5 are positioned in each of the shells 2,3 a conformed plate 10 is made to rest on the corrugated edges 5*c* of the elements 5. The conformed plate 10 is of a rectangular shape (FIG. 1) and is provided with three semi-circular corrugations 11 which enter the corrugated edges 5*c* of the elements 5. Moreover, the semi-circular corrugations 11 have protruding areas 12 provided to enter within the recessed part of the elements 5 (FIG. 4).

Between the protruding areas 12 of the semi-circular corrugations 11, the conformed plates 10 are provided with a plurality of holes 13 enabling communication between the inside of the conduct made by two superimposed plates 10 maintained by the holder elements 5 and the volumes formed by the two superimposed shells 2,3.

Taking into account the characteristics of the internal combustion engine to be fitted with the silencer according to the invention, the holes 13 are provided in a smaller or greater number. It is also possible to provide holes 12*a* in the protruding areas 12, the holes 12*a* making a communication of the tubes formed by the two superimposed plates 10 with the recessed inside portion of the holder elements 5 (FIG. 5). This makes it possible to work on the inner volumes of the silencer while enabling an expansion and then a circulation along a folded path of the gaseous products coming from the engine through a pipe 20. The gaseous products are thus expanded and cooled down and can exit through the end pipe 21 towards the atmosphere while completely restricting the noise thereof.

According to the path of the compressed hot gaseous products in the tube 20, the type of the engine, the power efficiency of the engine, and whether the engine works as a two-or four-stroke engine or if it is a diesel engine, it is possible to modify not only the number of the elements 5, but also the distance separating the elements 5 and therefore the distance separating the protruding areas 12 of the conformed plates 10. The number of holes 13 in the conformed plates 10 can further vary, as well as the number of holes 12*a* in the protruding areas 12, in order that the exhaust products will be evacuated by the tube 21 in the best possible condition.

It is obvious that the constituent parts of the silencer, i.e. the two shells 2,3, the holder elements 5 and the conformed plates 10 are all crimped together on the flanges 2*a*, 3*a* of the two shells 2,3. All the constituent parts of the silencer are made in stainless steel or similar material which suitably resists the products exhausted from the engine of an automobile vehicle.

The invention is not limited to the embodiment shown and described in detail since variations and modifications can be made without departing from the scope of the present invention.

I claim:

1. A silencer for the exhaust systems of automotive vehicles and the like, said silencer consisting essentially entirely of stainless steel, said silencer comprising an assembly of a pair of formed plates, a pair of shells, and a plurality of holder elements, said holder elements having a box-like cross-sectional shape having a bottom portion and a pair of wing portions extending therefrom, said shells being formed with transverse corrugation means each adapted to receive a bottom portion of one of said holder elements, the ends of said wing portions being formed to receive mating portions of said formed plates, and said shells being formed with edge flanges adapted to be crimped together to thereby secure said assembly of said holder elements, said formed plates and said shells together.

2. The silencer of claim 1, said formed plates having portions which define exhaust gas conduit means in the assembled together condition of said silencer, said conduit means defining portions of said formed plates being formed with openings which communicate the space within said conduit means with the space within said shells in the assembled together condition of said silencer, and said conduit means defining portions in each said formed plate being of semi-circular configuration.

3. The silencer of claim 1 or 2, wherein said formed plates are formed with holes in the areas thereof between said holder elements.

4. The silencer of claim 1 or 2, wherein said holder elements are held in place between said shells and said formed plates in the assembled together condition of said silencer by said crimped edges and without any soldering.

* * * * *